US006257025B1

(12) United States Patent
Fray

(10) Patent No.: US 6,257,025 B1
(45) Date of Patent: Jul. 10, 2001

(54) KNITTED HOSIERY WITH SELF-CLOSING END AND METHOD OF KNITTING

(76) Inventor: Edward H. Fray, P.O. Box 213, Dublin, PA (US) 18917

( * ) Notice: Subject to any disclaimer, the term of this patent is extended or adjusted under 35 U.S.C. 154(b) by 0 days.

(21) Appl. No.: 09/771,278

(22) Filed: Jan. 26, 2001

(51) Int. Cl.[7] ..... D04B 9/46

(52) U.S. Cl. ..... 66/185; 66/178 R

(58) Field of Search ..... 66/21, 22, 25, 66/40, 215, 147, 148, 172 R, 172 E, 178, 179, 182, 183, 185, 186, 187, 184; 2/239, 241

(56) References Cited

U.S. PATENT DOCUMENTS

| | | | | |
|---|---|---|---|---|
| 2,026,745 | | 1/1936 | Martel | 66/51 |
| 2,077,557 | | 4/1937 | Gastrich | 66/178 |
| 2,301,065 | | 11/1942 | Mills | 66/50 |
| 2,663,175 | | 12/1953 | Pons | 66/179 |
| 2,718,769 | | 9/1955 | Fischer | 66/185 |
| 2,821,847 | | 2/1958 | Getaz | 66/185 |
| 2,974,506 | | 3/1961 | Lawson | 66/51 |
| 3,453,843 | | 7/1969 | Knohl et al. | 66/185 |
| 3,721,111 | * | 3/1973 | Billi | 66/187 |
| 3,905,212 | | 9/1975 | Bounous et al. | 66/185 |
| 3,969,911 | | 7/1976 | Lonati | 66/95 |
| 4,015,448 | * | 4/1977 | Knohl | 66/185 |
| 4,198,834 | | 4/1980 | Reid, Sr. | 66/172 |
| 4,561,266 | | 12/1985 | Häcker | 66/51 |
| 4,697,440 | | 10/1987 | Riccitelli | 66/177 |
| 4,712,390 | | 12/1987 | Lonati | 66/54 |
| 4,856,300 | | 8/1989 | Lonati | 66/221 |
| 5,907,960 | | 6/1999 | Lonati et al. | 66/28 |

* cited by examiner

*Primary Examiner*—Danny Worrell
(74) *Attorney, Agent, or Firm*—Synnestvedt & Lechner LLP

(57) ABSTRACT

A method for knitting hosiery or similar tubular knit structures, and hosiery knitted according to the method, are disclosed. A plurality of first courses are knitted on a circular knitting machine using a first group of needles being a fraction of the total number of needles on the machine. Selected needles of the first group are taken out of action, but the final course knitted is retained on the needles out of action. The needles still in action are used to knit a plurality of second courses. After the second courses are complete, the needles out of action are brought back into action, and a third plurality of courses is knitted using all the needles of the first group. The second plurality of courses folds over upon itself to form a double layer of adjacent courses surrounding an opening. Further courses are knitted using more needles, the number of needles in action determining the size of the hose.

33 Claims, 4 Drawing Sheets

FIG. 4
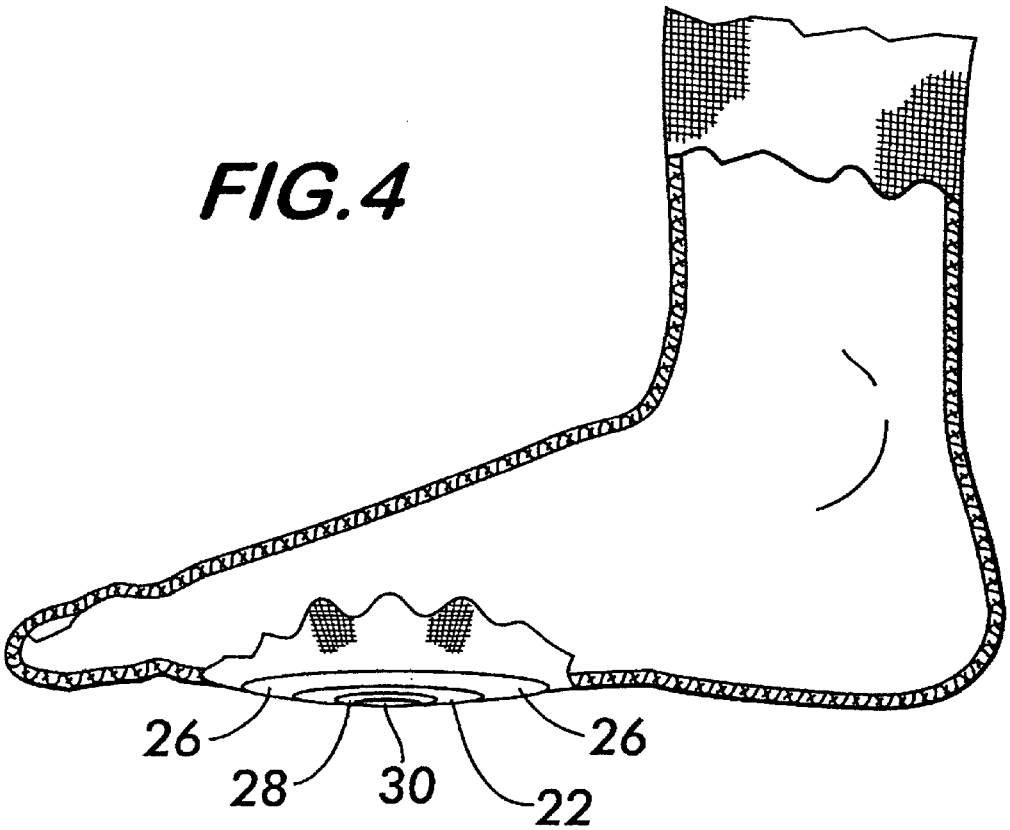
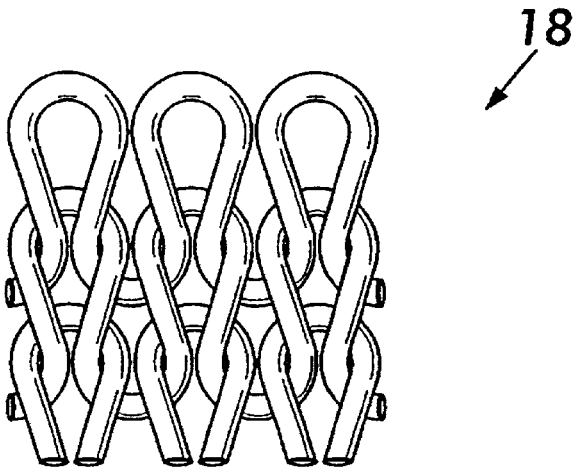
FIG. 5

KNITTED HOSIERY WITH SELF-CLOSING END AND METHOD OF KNITTING

FIELD OF THE INVENTION

This invention relates to knitted tubular structures such as hosiery having a self-closing end formed at the toe and a method for knitting such hosiery.

BACKGROUND OF THE INVENTION

Knitted hosiery, such as socks, womens' stockings and panty hose, have traditionally been knitted from the open end toward the toe of the garment, leaving an opening in the toe which is then closed by a separate manufacturing step. In one common procedure, the garment is transferred from the knitting machine to a sewing machine where an operator sews the opening closed, thereby finishing the hosiery.

It has long been recognized that this method of manufacturing hosiery is costly and inefficient because it requires extra manufacturing steps, more than one machine and a skilled operator performing a series of hand operations to complete a garment. This problem has been addressed in the past by the development of knitting methods and machines which knit hosiery with a closed toe automatically, but such machines tend to be very specialized, are complicated in construction and operation and costly to purchase and operate. There is clearly a need for a simplified, efficient, fully automated method of knitting hosiery which does not require expensive, specialized machinery or separate hand operations to produce acceptable hosiery.

SUMMARY AND OBJECTS OF THE INVENTION

The invention concerns a method of knitting tubular structures such as hosiery on a circular knitting machine having a plurality of needles. The method comprises knitting a plurality of first, substantially circular courses of stitches using a first group of machine needles to form a toe end of the hose. The first courses of stitches include at least an initial course of stitches and a final course of stitches.

A plurality of second, substantially circular courses of stitches are knitted using a second group of the needles. The second group has fewer needles than the first group, but the needles comprising the second group are drawn from among the needles comprising the first group. During knitting of the second courses of stitches, the final course of stitches (of the first courses) is retained on those needles of the first group which are not included in the second group.

A plurality of third, substantially circular courses of stitches are knitted using the needles of the first group.

A plurality of fourth, substantially circular courses of stitches are knitted using a third group of the needles. The third group has a greater number of needles than the first group but includes the first group of needles. Further pluralities of courses may also be knitted, preferably using more needles, but also using fewer.

For hosiery which is symmetrical at the toe, the needles comprising the first and second groups are substantially evenly space apart from one another around the knitting machine. Elastic yarn is preferably used in the area of the toe, the yarn being knitted under tension.

The invention also contemplates hosiery or similar tubular structures knitted according to the method described above. Hosiery according to the invention comprises a plurality of first, substantially circular courses of stitches defining a toe end. The plurality of first courses includes at least an initial course of stitches and a final course of stitches. Each of the first courses comprising a first number of stitches.

The hose also has a plurality of second, substantially circular courses of stitches comprising a second number of stitches, fewer in number than the first number of stitches. The plurality of second courses includes a beginning course of stitches and an end course of stitches. The beginning and the end courses are interknitted with the final course of stitches of the first courses. The second courses are reverse folded and form a double layer of adjacent courses at the toe end of the hosiery.

A plurality of third, substantially circular courses of stitches is also included in the hose. Each of the third courses comprise a third number of stitches equal in number to the first number of stitches. The third courses include a primary course of stitches interknitted with the end course of the second courses. The hose also has a plurality of fourth substantially circular courses of stitches, each of the fourth courses comprising a fourth number of stitches greater in number than the third number of stitches. At least one course of the plurality of fourth courses is interknitted with one course of the plurality of third courses. Additional pluralities of courses may also be added to the hose.

It is an object of the invention to provide a method of knitting hosiery which does not require manufacturing steps other than knitting to form a substantially closed toe.

It is another object of the invention to provide a method of knitting hosiery which can be performed on commonly available circular knitting machines.

It is still another object of the invention to provide a method of knitting hosiery from the toe end to the open end of the hose.

It is yet another object of the invention to provide hosiery which can be knitted from the toe having a substantially closed toe end.

It is yet again another object of the invention to provide a knitting method which is suitable to knit tubular structures other than hosiery.

These and other objects of the invention will become apparent upon consideration of the following drawings and detailed description of preferred embodiments of the invention.

BRIEF DESCRIPTION OF THE DRAWINGS

FIG. 4 shows hosiery according to the invention on the foot of a wearer;

FIG. 5 shows, on an enlarged scale, stitches used to knit hosiery; and

DETAILED DESCRIPTION OF PREFERRED EMBODIMENTS

Figure 1:
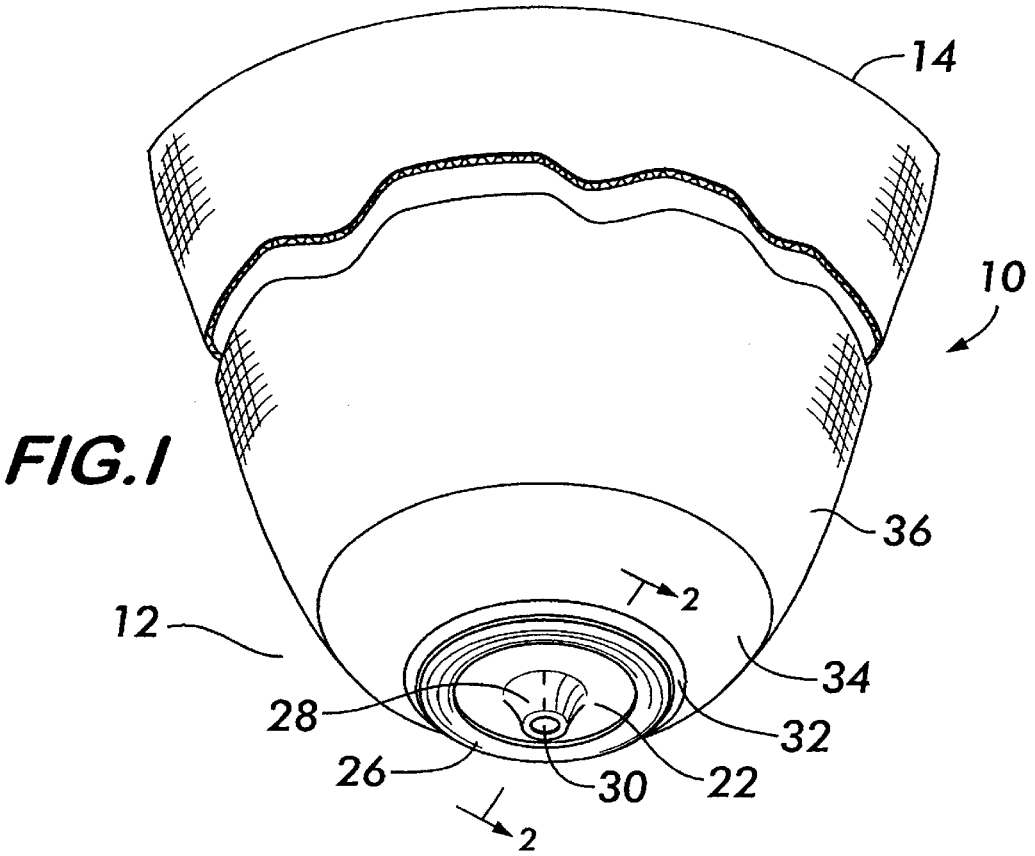
FIG. 1 shows a perspective view of a knitted item of hosiery according to the invention.

FIG. 1 illustrates an item of hosiery according to the invention, namely hose 10, having a toe end 12 and an open end 14. Hose 10 is knitted, preferably on a circular knitting machine, and may be a sock, a womens' stocking (thigh high or knee high), a leg of panty hose, a leotard, a body suit, a therapeutic sock or a sock used beneath a prosthetic device to cite some examples.

Hose 10 is knitted of yarns comprising material appropriate to the particular type or use of the hose. For example, socks may be knitted of wool or cotton, either alone or blended with synthetic fibers such as polyester for durability or elastomeric yarns such as spandex for elasticity. Denier of the yarns may range from 10 for dress socks, to 1500 for athletic socks. Womens' stockings may be knitted of yarns of silk, nylon and nylon/spandex and range from a denier of 10 for an ultra sheer stocking to as high as 80 for an opaque effect such as desired for tights or a body suit. The term "yarns" as used herein is a generic term for a continuous strand of textile fibers, filaments or material in a form suitable for knitting, weaving, braiding or otherwise intertwining to form a textile fabric. The term "yarn" includes a number of fibers twisted together, a number of filaments laid together without twist and a monofilament to cite some examples.

METHOD OF MANUFACTURE

Figure 2:
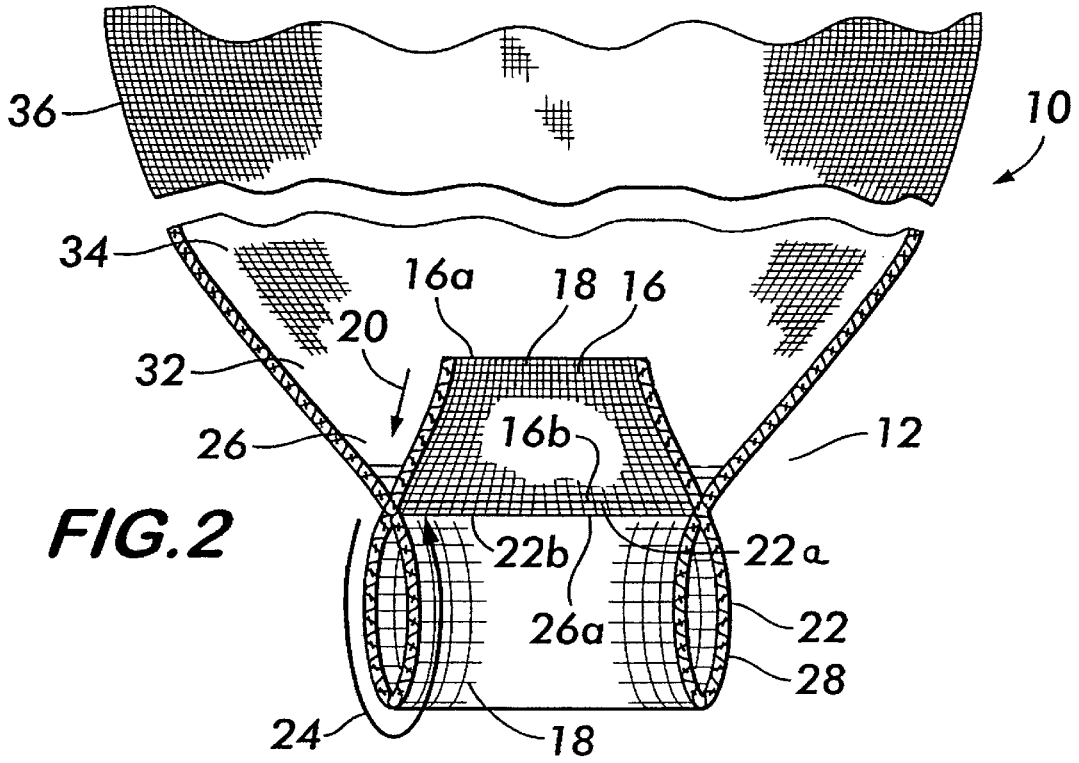
FIG. 2 shows a longitudinal sectional view of the hosiery item taken along line 2—2 of FIG. 1.
Figure 6:
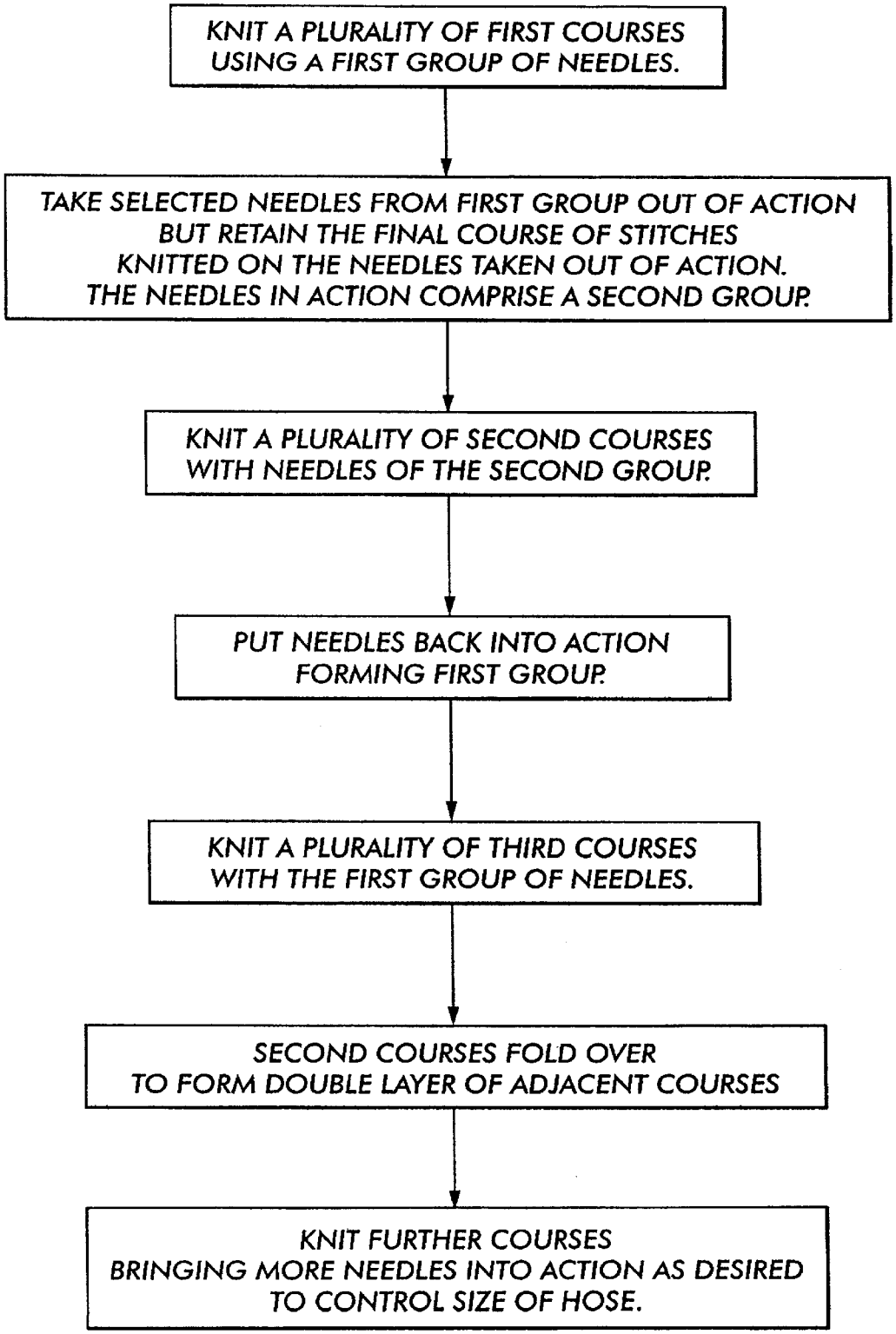
FIG. 6 presents a flow chart describing the steps of the method according to the invention.

Hose 10, shown in FIG. 2, is formed on a circular knitting machine (not shown) by the method according to the invention as described in FIG. 6. Beginning at the toe end 12, a plurality of substantially circular first courses 16 of stitches 18 are knitted starting from an initial course 16*a* and ending at a final course 16*b* as shown by the arrow 20. The stitches 18 are shown schematically as cross hatched regions on the hose which represent yarns knitted together as shown in detail on an enlarged scale in FIG. 5. It is understood that the invention is not limited to the example stitch shown and any type of stitch or combination of stitches are feasible.

The first courses 16 are knitted with a first group of needles comprising some fraction of the needles available on the machine. (Specific numerical examples of the method are provided below.) The fraction of the needles used in the first group is determined by how small of an opening is desired in the toe end (described in detail below). The more needles used the larger the opening will be. For a symmetric hose the needles of the first group are spaced at equal intervals around the knitting machine. Other spacing intervals are possible to create other than symmetric hose.

After the desired number of first courses are knitted, selected needles of the first group are taken out of action, but the final course of stitches 16*b* is retained on the needles taken out of action. Retaining the final course prevents the stitches being knitted from being cast off. Subsequent courses of stitches are knitted on the needles still in action. The manner in which the needles are taken out of action is dependent upon the particular design of the knitting machine being used and may be effected, for example, by means of selector jacks which control each needle.

Figure 3:
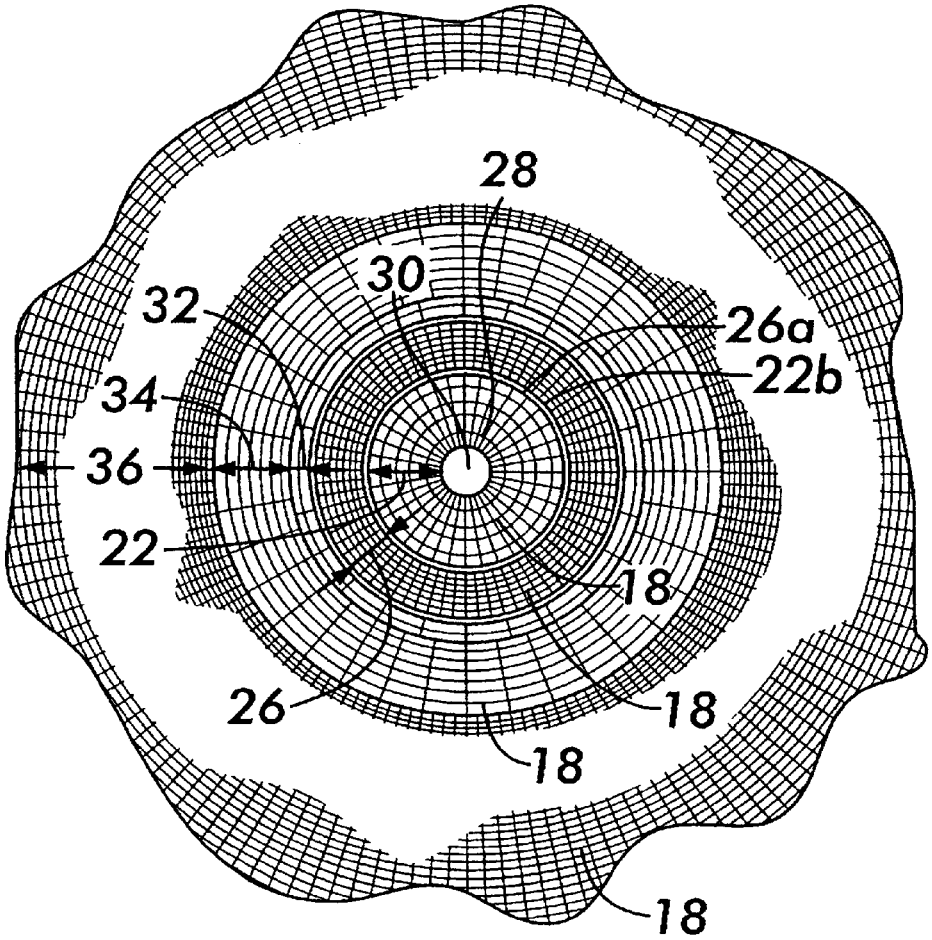
FIG. 3 shows an end view of the hosiery item of FIG. 1.

The number of needles taken out of action is preferably half the number of needles in the first group. However, virtually any fraction may be used to achieve the hose according to the invention. The needles which remain in action form a second group, and comprise a fraction of the needles of the first group. The second group of needles are used to knit a plurality of substantially circular second courses 22 of stitches 18 shown in FIGS. 2 and 3. Second courses 22 start with a beginning course 22*a* and end with an end course 22*b* and are knitted in the direction as shown by arrow 24. Beginning course 22*a* is interknitted continuously with final course 16*b* of the first courses. Second courses 22 have relatively fewer stitches 18 than first courses 16 due to the fewer number of needles in group 2 as compared with group 1. For a symmetric hose, the needles of the second group are spaced at equal intervals around the knitting machine. Other spacing intervals are possible to create other than symmetric hose.

After the desired number of second courses are formed, the needles previously taken out of action are brought back into action, the group, thus, formed corresponding to the original first group. The first group of needles are then used to knit a substantially circular plurality of third courses 26. Courses 26 begin with a primary course 26*a* which is interknitted with the end course 22*b* of second courses 22. However, because the stitches of final course 16*b* of the first courses 16 was retained on the needles which are brought back into action upon knitting the third courses, the second courses 22 are caused to fold over as shown by arrow 24 and form a double layer of adjacent courses 28 at the toe end surrounding an opening 30. One course of each of the first, second and third courses are all interknitted together when the needles retaining the final course of stitches are brought back into action. By bringing the needles back into action, the item will no longer be a double thickness, and the knitting continues as for a conventional hose.

After the desired number of third courses 26 are knitted, further plural courses such as 32, 34 and 36 may be knitted using more needles on the machine with each course. Using more needles causes the diameter of the hose to enlarge, thus, a desired size hose may be created by progressively knitting courses with more and more needles.

Although opening 30 is formed at the toe end of hose 10 by the method of knitting according to the invention, the opening is not significant because it can be made arbitrarily small so as to appear closed and, as explained below, does not align with the toes of the foot when the hose is worn. The opening may be made smaller by increasing the tension at which the second courses of yarns are knit during the knitting process, as well as how many needles are used in the first and second courses. Tension on the order of about 50% to about 98% of ultimate yarn strength is feasible with a tension of about 70% to about 90% of ultimate yarn strength being preferred. As stated above, the opening will not align with the toes of the foot but tends to locate itself on the sole near the ball of the foot as shown in FIG. 4. This self-locating characteristic occurs because the distance from the toe to the ankle, when measured across the top of the foot, is shorter than the distance from toe to ankle measured across the bottom of the foot, and the tip of the hose where the hole is tends to be pulled beneath the foot to compensate for this difference in distance.

It is preferred to provide elastic yarns, such as spandex, in the first and second courses. This allows the opening to close up by itself automatically after it has been stretched open. Furthermore, using nylon in the first courses will help the knitting to start and proceed smoothly.

As noted above, items knitted according to the method of the invention are not limited as to the type of stitch used, which could be a regular knit loop as shown in FIG. 5, a flat or jersey stitch, a run resistant flat knit stitch, a purl stitch, a rib stitch or an interlock stitch to cite some examples.

EXAMPLES OF HOSIERY KNITTED ACCORDING TO THE INVENTION

Example 1

Men's crew socks knitted of spun fibers such as wool or cotton yarns of 4–50 count on a circular knitting machine having a total of 108 needles, having four first courses knitted with 36 needles, 48 to 96 second courses knitted using 18 needles, 48 to 96 third courses knitted using 36 needles, 48 to 96 fourth courses using 72 needles and a number of fifth courses using all 108 needles of the machine.

Example 2

Ladies' stockings, pantyhose, knee-highs, thigh-highs and peds knitted of nylon, nylon-spandex or other yarns or yarn combinations of 10–100 denier on a circular knitting machine having a total of 400 needles, having four first courses knitted using 120 needles, 48 to 96 second courses knitted using 60 needles, 48 to 96 third courses knitted using 120 needles, 48 to 96 fourth courses using 240 needles and a number of fifth courses using all 400 needles of the machine.

The method of knitting hosiery according to the invention promises to provide an efficient knitting method which can be performed on commonly available circular knitting machines, requires only one machine to complete a garment, eliminates the need for hand operations by skilled operators, allows the hose to be knitted from the toe to the open end and yet have a substantially closed toe. These advantages should allow hosiery to be produced more quickly and less expensively than current production techniques allow.

Although the description and examples of the invention discussed above concern hosiery primarily, it is to be understood that the knitting method according to the invention is not limited to the production of hosiery only and may be employed to manufacture any similar tubular knit structure.

What is claimed is:

1. A method of knitting a tubular structure on a circular knitting machine having a plurality of needles, said tubular structure having a substantially closed toe end and an open end, said method comprising the steps of:

knitting a plurality of first substantially circular courses of stitches using a first group of said needles to form a toe end, said first courses of stitches including at least an initial course of stitches and a final course of stitches;

knitting a plurality of second substantially circular courses of stitches using a second group of said needles fewer in number than said first group of said needles, said needles comprising said second group being drawn from among said needles comprising said first group, said final course of stitches being retained on said needles of said first group not comprising said second group during knitting of said second courses of stitches;

knitting a plurality of third substantially circular courses of stitches using said needles of said first group; and knitting a plurality of fourth substantially circular courses of stitches using a third group of said needles greater in number than said first group of said needles, but including said first group of said needles.

2. A method according to claim 1, wherein said tubular structure comprises hosiery.

3. A method according to claim 1, further comprising the step of knitting further pluralities of substantially circular courses of stitches.

4. A method according to claim 1, wherein said needles comprising said first group are substantially evenly spaced apart from one another around said knitting machine, and said needles comprising said second group are substantially evenly spaced apart from one another around said knitting machine.

5. A method according to claim 1, wherein said second courses of stitches are knitted of yarns comprising elastic yarn.

6. A method according to claim 5, wherein said elastic yarn is knitted while under a tension force.

7. A method according to claim 6, wherein said tension force is within about 50% to about 98% of the ultimate strength of said elastic yarn.

8. A method according to claim 6, wherein said tension force is within about 70% to about 90% of the ultimate strength of said elastic yarn.

9. A method according to claim 5, wherein said elastic yarn comprises spandex.

10. A method according to claim 5, wherein said third courses of stitches comprise a second yarn knitted with said elastic yarn.

11. A method according to claim 5, wherein said first courses of stitches comprise four courses knitted using 36 needles.

12. A method according to claim 11, wherein said second courses of stitches comprise between about 48 and 96 courses knitted using 18 needles.

13. A method according to claim 12, wherein said third courses of stitches comprise between about 48 and 96 courses knitted using 36 needles.

14. A method according to claim 13, wherein said fourth courses of stitches comprise between about 48 and 96 courses knitted using 72 needles.

15. A method according to claim 14, further comprising a plurality of fifth courses of stitches knitted using 108 needles.

16. A method according to claim 5, wherein said first courses of stitches comprise four courses knitted using 120 needles.

17. A method according to claim 16, wherein said second courses of stitches comprise between about 48 and 96 courses knitted using 60 needles.

18. A method according to claim 17, wherein said third courses of stitches comprise between about 48 and 96 courses knitted using 120 needles.

19. A method according to claim 18, wherein said fourth courses of stitches comprise between about 48 and 96 courses knitted using 240 needles.

20. A method according to claim 19, further comprising a plurality of fifth courses of stitches knitted using 400 needles.

21. A knitted tubular structure, comprising:

a plurality of first substantially circular courses of stitches defining a toe end, said plurality of first courses including at least an initial course of stitches and a final course of stitches, each of said first courses comprising a first number of stitches;

a plurality of second substantially circular courses of stitches comprising a second number of stitches fewer in number than said first number of stitches, said plurality of second courses including a begining course of stitches and an end course of stitches, said begining and said end courses being interknitted with said final course of stitches of said first courses, said second courses being reverse folded and forming a double layer of adjacent courses at said toe end;

a plurality of third substantially circular courses of stitches comprising a third number of stitches equal in number to said first number of stitches, said third courses including a primary course of stitches interknitted with said end course of said second courses; and a plurality of fourth substantially circular courses of stitches, each of said fourth courses comprising a fourth number of stitches greater in number than said third number of stitches, at least one course of said plurality of fourth courses being interknitted with one course of said plurality of third courses.

22. A knitted tubular structure according to claim 21, wherein said structure comprises hosiery.

23. A knitted tubular structure according to claim 21, further comprising further pluralities of substantially circular courses of stitches.

24. A knitted tubular structure according to claim 21, wherein said first and second courses comprise an elastic yarn.

25. A knitted tubular structure according to claim 24, wherein said elastic yarn is spandex.

26. A knitted tubular structure according to claim 21, wherein the number of stitches in said plurality of second courses is about half the number of stitches in said plurality of first courses.

27. A knitted tubular structure according to claim 21, wherein said plurality of second courses are arranged substantially concentric with said plurality of first courses.

28. A knitted tubular structure according to claim 27, wherein said plurality of third courses are arranged substantially concentric with said plurality of second courses.

29. A knitted tubular structure according to claim 28, wherein said plurality of fourth courses are arranged substantially concentric with said plurality of third courses.

30. A knitted tubular structure according to claim 29, further comprising a plurality of fifth courses arranged substantially concentric with said plurality of fourth courses.

31. A knitted tubular hosiery article having a toe end, an open end and a side serving as a sole, said article comprised of multiple courses concentrically knitted and defining an opening at said toe end, said opening being surrounded by a double layer of courses arranged adjacent to one another, said opening being displaced from the toe of a wearer and positioned at a point intermediate the toe and the heel on said side of said article serving as the sole when said article is worn.

32. A knitted tubular hosiery article according to claim 31, wherein said multiple courses comprise:

a plurality of first substantially circular courses of stitches defining said toe end, said plurality of first courses including at least an initial course of stitches and a final course of stitches, each of said first courses comprising a first number of stitches;

a plurality of second substantially circular courses of stitches comprising a second number of stitches fewer in number than said first number of stitches, said plurality of second courses including a begining course of stitches and an end course of stitches, said beginning and said end courses being interknitted with said final course of stitches of said first courses, said second courses being reverse folded and forming said double layer of adjacent courses surrounding said opening;

a plurality of third substantially circular courses of stitches comprising a third number of stitches equal in number to said first number of stitches, said third courses including a primary course of stitches interknitted with said end course of said second courses; and a plurality of fourth substantially circular courses of stitches, each of said fourth courses comprising a fourth number of stitches greater in number than said third number of stitches, at least one course of said plurality of fourth courses being interknitted with one course of said plurality of third courses.

33. A knitted tubular hosiery article according to claim 32, wherein said first and second courses comprise an elastic yarn.

* * * * *